United States Patent [19]

Bonafos

[11] 4,056,167

[45] Nov. 1, 1977

[54] EMERGENCY ELEVATOR

[75] Inventor: Raymond Bonafos, Ris Orangis, France

[73] Assignee: Societe Nationale Elf Aquitaine (Production), Courbevoie, France

[21] Appl. No.: 707,053

[22] Filed: July 20, 1976

[30] Foreign Application Priority Data

July 23, 1975 France ..... 75.23001

[51] Int. Cl.[2] ..... A62B 1/02

[52] U.S. Cl. ..... 182/10

[58] Field of Search ..... 182/10, 5, 6, 7, 191, 182/192, 193

[56] References Cited

U.S. PATENT DOCUMENTS

| | | | |
|---|---|---|---|
| 297,843 | 4/1884 | Pittman | 182/191 |
| 3,826,335 | 7/1974 | Allen | 182/10 |

*Primary Examiner*—Reinaldo P. Machado

*Attorney, Agent, or Firm*—Brisebois & Kruger

[57] ABSTRACT

Apparatus for automatically escaping from a derrick comprises a chamber movable along a cable attached at one end to said derrick, and an automatically releasable system for holding the chamber at the derrick end of the cable, said system comprising a release pin connected to be actuated when a person jumps into the chamber. The chamber comprises a light metallic frame and a flexible pocket connected by a chain to said release pin.

4 Claims, 5 Drawing Figures

EMERGENCY ELEVATOR

SUMMARY OF THE INVENTION

Devices for escaping from a derrick (of the type used in drilling oil wells, for example) are quite similar in nature and currently known "stop falls." These are based on a cable one end of which is attached above the bridge of the derrick and the other to a fixed point outside the safety perimeter.

They comprise a vertical tube about one meter long, to the lower end of which a horizontal tube is welded. The person in danger positions himself on this T-shaped device. A steel box is attached to the upper part of the vertical tube and contains two pulleys together with a braking system manually controlled by a lever.

In another model the horizontal bar is replaced by two cable loops forming the outline of a chair and into which the person in danger must insert his legs.

The person who must escape from the bridge of the derrick must therefore seat himself in the loops, or on the horizontal bar, with his legs on the opposite sides of the vertical tube, grip this tube with one hand, and actuate the brake with the other. All this supposes that he is in full possession of his physical and mental faculties, has not lost his presence of mind, that he quickly detaches the stop-fall from the bridge, and that no misadventure has deprived him of use of his hands or eyes.

In order to overcome these disadvantages by providing for automatic, immediate, and safe escape, the apparatus according to the invention comprises a movable chamber carried by a cable and an automatic locking and releasing system. The device is released by a retractable pin and locked by a catch fixed to the end of a telescopic arm.

The following description will make it easier to understand the invention as illustrated in the accompanying drawings, in which.

Figure 1:
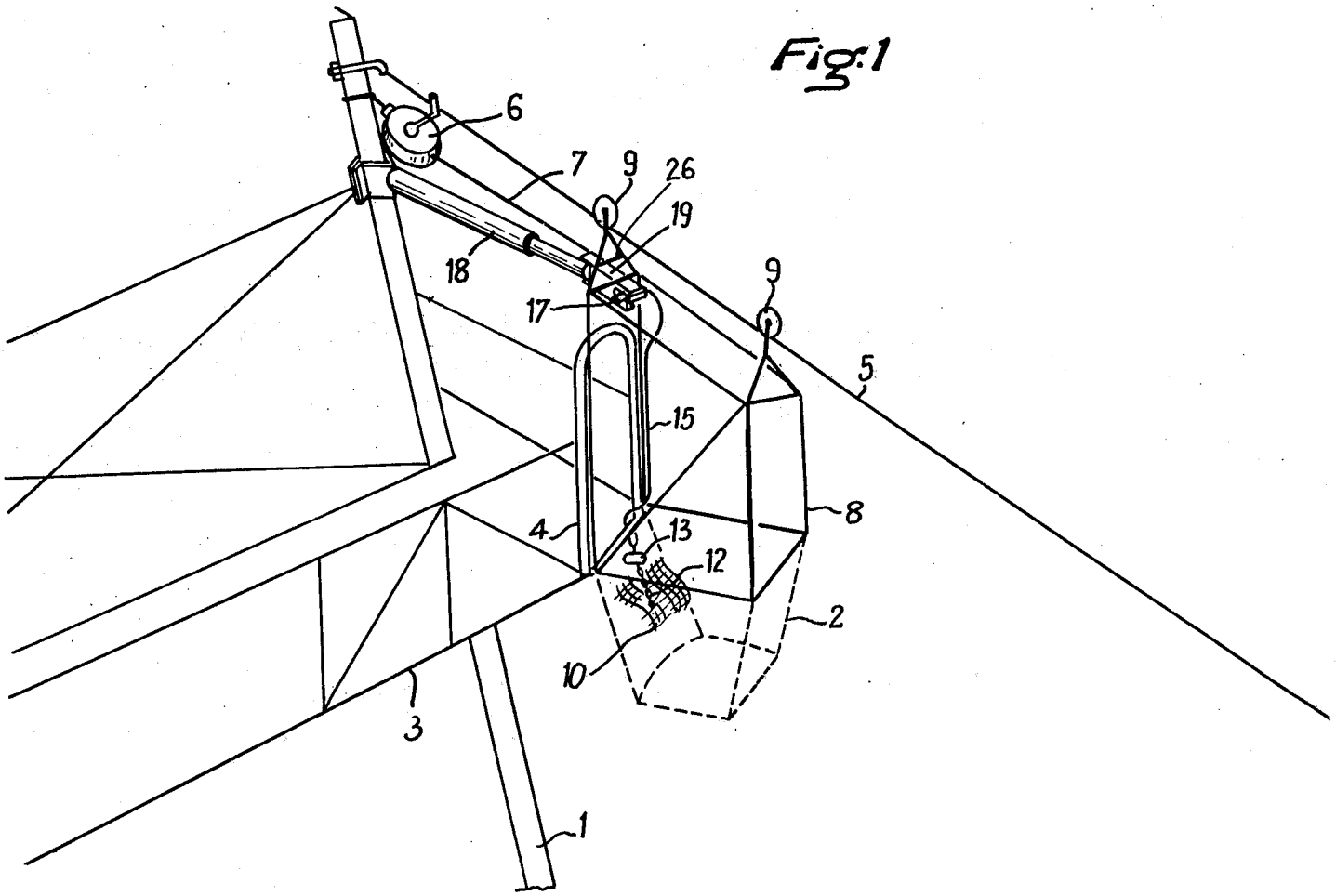
FIG. 1 is a schematic assembly view of the device.

Referring now to FIG. 1, this shows the derrick 1, the handrail of which comprises an arch 4 serving as an emergency exit. The chamber 2 is kept close to this exit.

The chamber 2 is suspended from a supporting cable 5 about 50 meters long, the upper end of which is attached above the bridge and the lower end of which is attached to a fixed point outside the safety perimeter.

A winch-controlled device for automatically slowing the descent is fixed to the derrick and connected to the chamber by its cable 7 fast to the tube 26. This device is similar to one of J.R.G. type commercially sold to brake vertical falls.

The chamber 2, which weighs about 35 kg, is made of a light metal frame 8 of an aluminum alloy for example, movable along the cable on two pulleys 9. The lower part is a sort of deep pocket made of asbestos cloth reinforced by a metallic net shown at 10 in a partially exploded view. The release pin 17 is connected to the cloth of the pocket by a Bowden wire, the lower end of which is provided with a small chain 12. This is fixed to the cloth. It also comprises a handle 13 serving as a manual emergency control.

Figure 2:
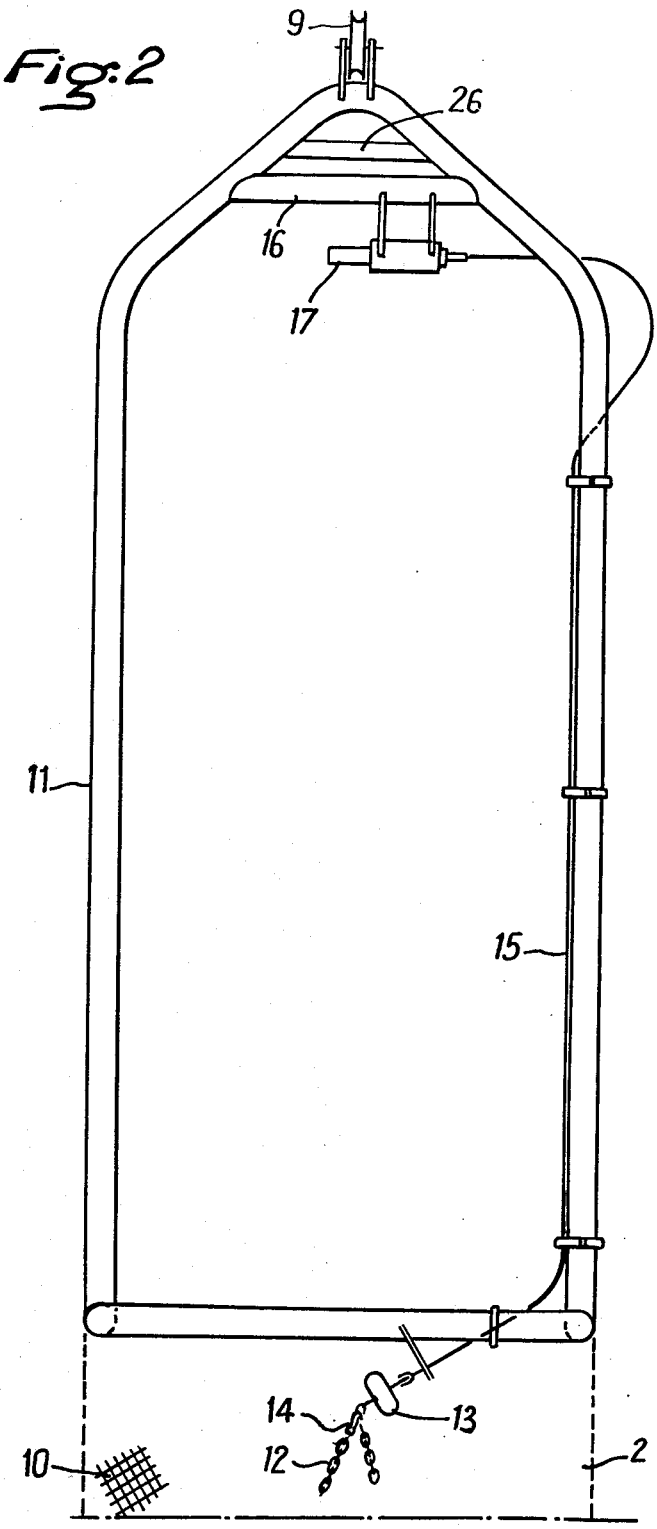
FIG. 2 shows the release system.

FIG. 2 clearly illustrates the release system. The person who desires to escape from the derrick jumps with his feet together into the chamber 2 positioned against the arch 4 of the emergency exit. The shock caused by the fall of the person into the chamber produces a tension in the cloth which, through the chain 12, the length of which may be regulated by a swivel hook 14, and the Bowden cord 15 actuates the retractable pin 17 releasing the chamber which descends with perfect stability.

Figure 3:
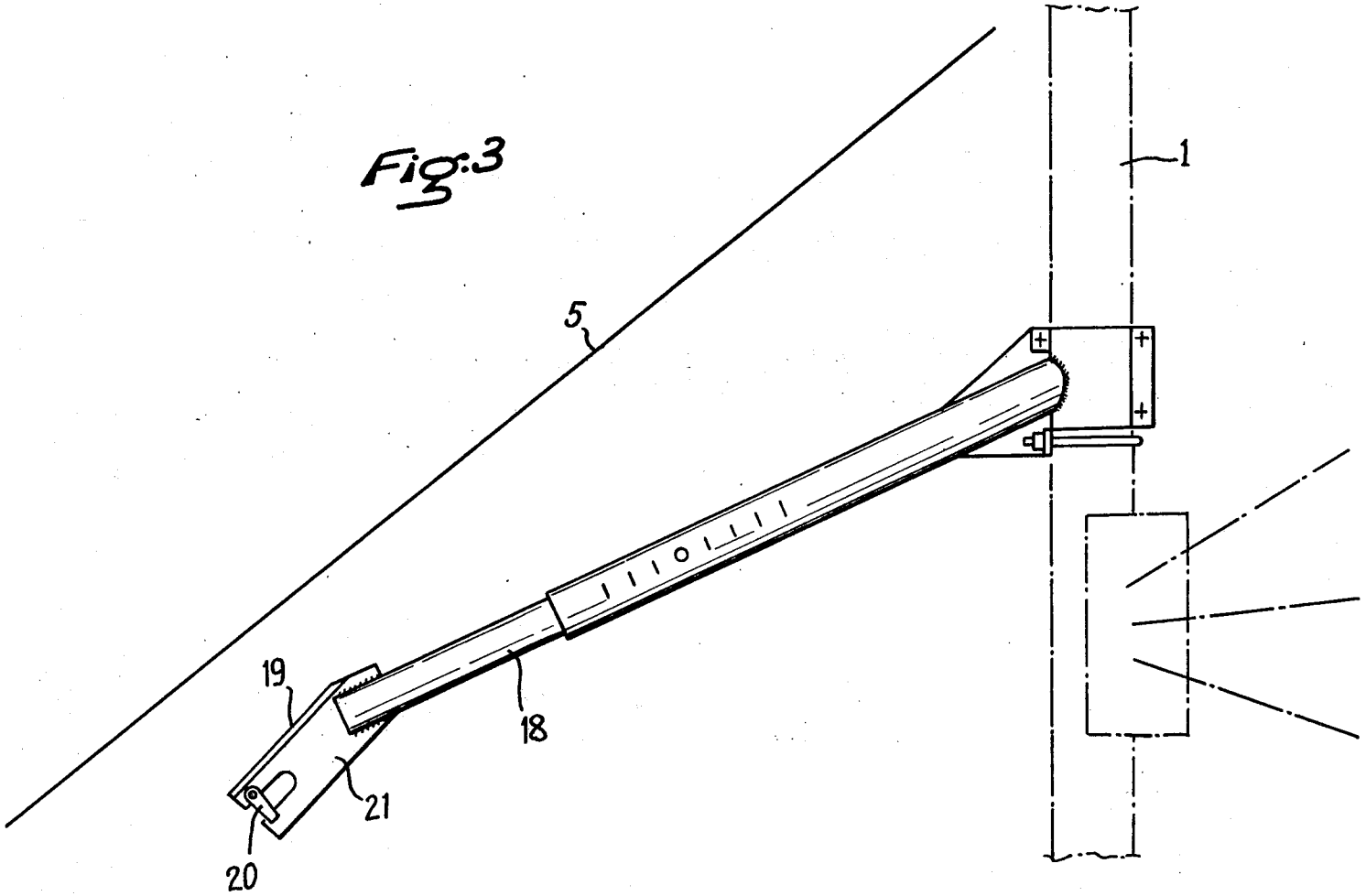
FIG. 3 shows the locking system.

FIG. 3 shows the latching system.

Figure 4:
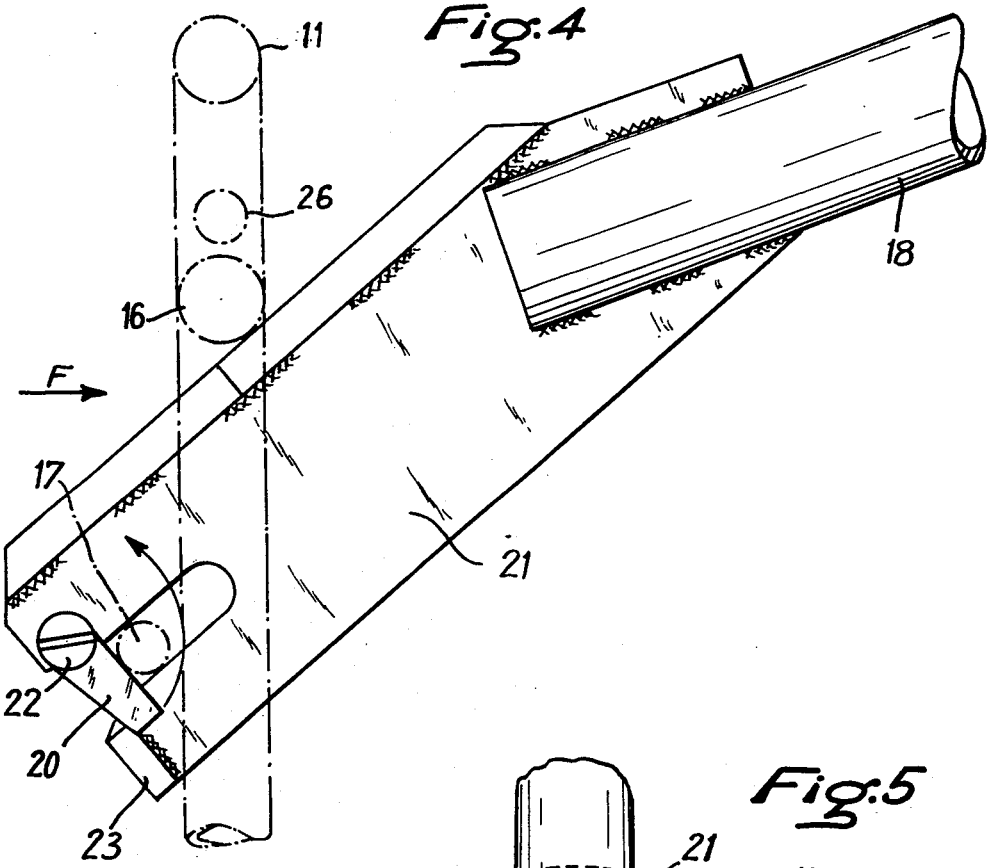
FIGS. 4 and 5 are detailed views of the release and locking systems.

FIG. 4 shows the release system as seen from the right.

Figure 5:
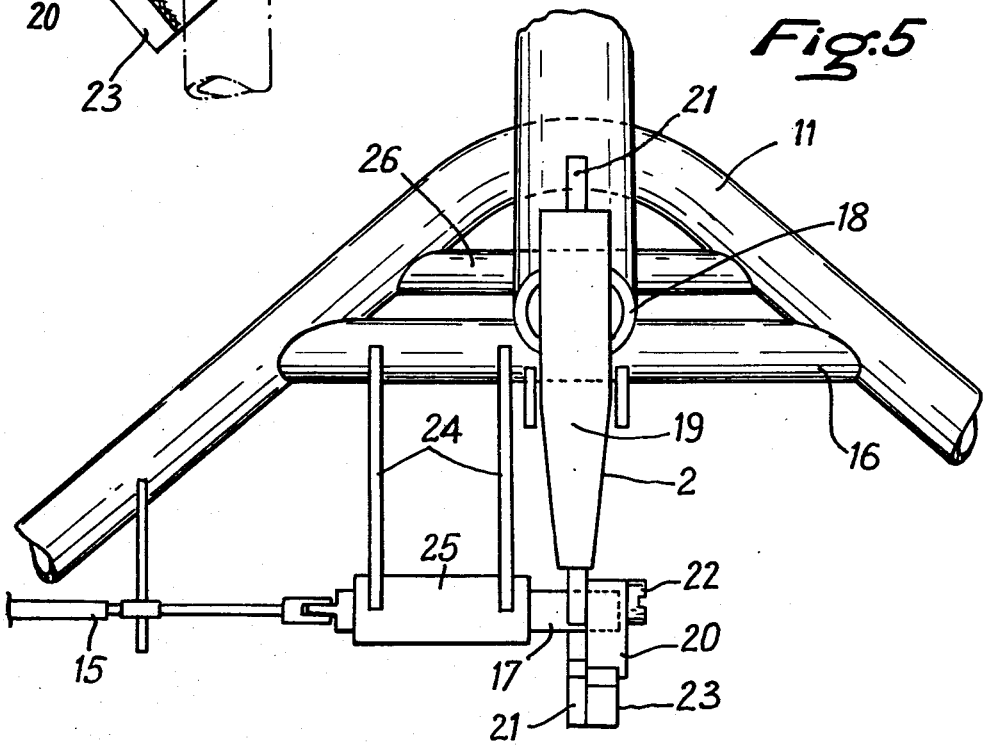

FIG. 5 shows the release system as seen from the direction of the arrow *f*.

Telescopic arm 18 attached to the upright of the derrick 1 carried at its other end a metallic plate 21, welded in a vertical plane, and provided with a notch. The arm 18 is made telescopic to facilitate its mounting.

The upper part of the plate is provided with a flat iron member 19 serving as a supporting ramp for the chamber which is carried on the tube 16 which rests on this ramp.

The notch in the plate is closed by a catch 20. When the chamber is brought to its upper position, this catch permits the passage of the retractable pin 17 by swinging about its own axis 22. Once this occurs, the catch falls into position over its abutment 23, thus locking the pin in its seat.

During the releasing step, the Bowden cord acts on the retractable part of the pin so as to separate it from the catch and thus permit the descent of the chamber. FIG. 5 shows the details of the mounting, in which the following reference numerals have been applied to the various components:

1. Derrick
2. Chamber
3. Bridge
4. Emergency exit
5. Supporting Cable
6. J.R.G.
7. Cable of J.R.G.
8. Reinforcement of Chamber
9. Pulley
10. Pocket of Chamber
11. Front Arch of the Chamber
12. Small chain
13. Emergency Control
14. Swivel Link
15. Bowden Cord
16. Tube Supporting the Chamber
17. Release Pin
18. Telescopic Arm
19. Ramp Supporting the Chamber
20. Retaining Catch
21. Metallic Plate
22. Axis of Catch
23. Abutment of Catch
24. Braces Supporting the Pin-Carrying Cylinder
25. Pin-Carrying Cylinder
26. Tube for Attachment of J.R.G. cable.

What is claimed is:

1. Apparatus for automatically escaping from a tall structure, said apparatus comprising a chamber formed by a light metal frame and a flame-resistant cloth pocket suspended from said frame, said chamber being mounted to travel on a cable attached at one end to said structure, and an automatically releasable latching system attached to said cloth pocket and adapted to connect said chamber to said structure when the chamber is empty but initiate the release and descent of the chamber upon the application of tension to said cloth when a person jumps into the chamber.

2. Apparatus for escaping from a tall structure as claimed in claim 1 in which said frame comprises a front arch and the releasable latching system comprises a retractable pin actuated by a cable connected to the cloth at the summit of said front arch.

3. Apparatus for escaping from a tall structure as claimed in claim 2 in which said frame is of an aluminum alloy, the top of said frame is provided with two pulleys rolling on the cable, and said pocket is made of asbestos cloth reinforced by metallic netting to which a chain connected to said retractable pin is attached.

4. Apparatus for escaping from a tall structure as claimed in claim 2 in which the chamber is latched to said structure by means of a telescopic arm fixed to the structure at one end and having at its other end a yoke closed by a catch in which the retractable pin is engaged.

* * * * *